US005616985A

United States Patent [19]

Hosotani

[11] Patent Number: 5,616,985

[45] Date of Patent: Apr. 1, 1997

[54] SHADOW-MASK COLOR CATHODE RAY TUBE

[75] Inventor: Nobuhiko Hosotani, Mobara, Japan

[73] Assignee: Hitachi, Ltd., Tokyo, Japan

[21] Appl. No.: 385,654

[22] Filed: Feb. 8, 1995

[30] Foreign Application Priority Data

Feb. 8, 1994 [JP] Japan ..... 6-014615

[51] Int. Cl.[6] ..... H01J 29/80

[52] U.S. Cl. ..... 313/403; 445/37; 445/47; 29/882

[58] Field of Search ..... 313/402, 403; 445/37, 47, 49; 29/882

[56] References Cited

U.S. PATENT DOCUMENTS

| | | | |
|---|---|---|---|
| 3,652,895 | 3/1972 | Tsuneta et al. | 313/403 |
| 3,686,525 | 8/1972 | Naruse et al. | 313/402 |
| 3,983,613 | 10/1976 | Palac et al. | 445/60 |
| 4,210,843 | 7/1980 | Avadani | 313/403 |
| 4,429,028 | 1/1984 | Kuzminski | 430/5 |
| 4,743,795 | 5/1988 | Thoms | 313/402 |
| 4,746,315 | 5/1988 | Sumiyoshi | 445/37 |
| 4,846,747 | 7/1989 | Higashinakagawa et al. | 445/47 |
| 5,000,711 | 3/1991 | Marks et al. | 445/47 |
| 5,243,253 | 9/1993 | Marks et al. | 313/402 |
| 5,396,145 | 3/1995 | Shiohara et al. | 313/402 |

*Primary Examiner*—Alvin E. Oberley
*Assistant Examiner*—Lawrence D. Richardson
*Attorney, Agent, or Firm*—Antonelli, Terry, Stout & Kraus, LLP

[57] ABSTRACT

A shadow-mask color cathode ray tube for producing a high-quality image by preventing the slot width or slot length of an electron-beam passing hole from increasing when a shadow mask is press-molded. The shadow mask in which the opening shape of an electron-beam passing hole formed in an effective area is of the slot type is press-molded and formed into an approximately rectangular approximately domed shape so that inequalities S3<S2 and S3<S2' are satisfied, where S3 is a width of a slot of an electron-beam passing hole located at an end of a vertical-directional outermost line at a horizontal-directional section in the effective area, S2 is a width of a slot of an electron-beam passing hole located adjacent to the electron-beam passing hole having the slot width S3 in a horizontal direction and at an end of a vertical-directional line adjacent to the vertical-directional outermost line, and S2' is a width of a slot of an electron-beam passing hole located adjacent to the electron beam passing hole having the slot width S2 in the vertical-directional line.

16 Claims, 4 Drawing Sheets

SHADOW-MASK COLOR CATHODE RAY TUBE

BACKGROUND OF THE INVENTION

1. Field of the Invention

The present invention relates to a shadow-mask color cathode ray tube, particularly to a shadow mask that prevents a beam landing tolerance from decreasing due to the deformation of an electron beam passing hole under press molding.

2. Description of the Prior Art

In general, a color cathode ray tube used for a television receiver or a monitoring terminal comprises a vacuum envelope comprising a panel section for forming an image screen, a neck section for accommodating an electron gun, and a funnel section for connecting the panel section with the neck section; a centering and purity correcting magnetic device externally set to the neck section; and a deflection yoke externally set to the border between the funnel and neck sections.

FIG. 2 is a sectional view of a shadow-mask color cathode ray tube for explanation in which symbol 1 represents a panel section, 2 represents a neck section, 3 represents a funnel section, 4 represents a phosphor layer, 5 represents a shadow mask, 6 represents a mask frame, 7 represents a panel pin, 8 represents a suspension spring, 9 represents a magnetic shield, 10 represents an electron gun, 11 represents a centering and purity correcting magnetic device, 12 represents a deflection yoke, Bc represents a central electron beam, and Bs represents a side electron beam.

In FIG. 2, a phosphor layer 4 is made of a three-color phosphor mosaic formed on the inner surface of the panel section 1, and a shadow mask structure is suspended from the panel pin 7 embedded in the inner wall through the suspension spring 8.

The shadow mask structure comprises the mask frame 6, the shadow mask 5 whose margin is spot-welded to the mask frame 6, and the magnetic shield 9 for shielding the space of the funnel 3 from external magnetism.

The funnel section 3 has the neck section 2 for accommodating the electron gun 10 at its small-diameter end and constitutes a vacuum envelope by frit-welding the open margin of the panel 1 to the large-diameter end margin.

The deflection yoke 12 is externally set to the neck transition portion of the funnel and an image is reproduced by two-dimensionally scanning the phosphor layer 4 formed on the inner surface of the panel section 1 by the electron beam 13 emitted from the electron gun 10.

The centering and purity correcting magnetic device 11 externally set to the neck section 2 is correction means for controlling the hue by adjusting the alignment of the electron-gun and tube axes and adjusting the mutual arrangement between three electron beams.

The shadow mask has the so-called color selecting function for correctly landing three electron beams emitted from an electron gun on a three-color phosphor mosaic constituting the phosphor layer 4 respectively.

The shadow mask is constituted by forming a flat plate into an approximately rectangular semi-finished product having an approximately rectangular effective face area in which a plurality of slot-like electron-beam passing holes are formed in the horizontal and vertical scanning directions of an electron beam and an ineffective area surrounding the effective area, and thereafter forming a skirt section by press-molding the semi-finished product to bend the ineffective area upward at the margin and forming the effective area into an approximately rectangular dome and welding the dome to a mask frame.

FIG. 3*a* is an illustration of a shadow mask, which is a top view of the shadow mask viewed from the electron gun. FIG. 3*b* is a cross sectional view of the shadow mask in FIG. 3*a*, taken along the line X—X of FIG. 3*a*.

In FIGS. 3*a* and 3*b*, symbol 5 represents a shadow mask, 51 represents a boundary (effective border) present at a transition portion between an effective area and a skirt section, 52 represents an effective area in which a slot is formed as an electron-beam passing hole, 53 represents a slot, and 54 represents a shadow-mask developed outline.

The shadow mask is suspended inside the panel section by spot-welding the four corners of the shadow mask to a mask frame (not shown).

FIGS. 4(A) to 4(D) are schematic process diagrams for explaining the outline of a shadow mask manufacturing method in which a shadow mask curved like a dome is formed in the sequence of (A)→(B)→(C)→(D).

First, a number of shadow mask patterns are formed on the low-carbon steel plate 1 shown in FIG. 4(A) by means of photography.

In the case of the shadow mask pattern, a shadow mask unit comprising the effective area 52 in which electron-beam passing holes (slots) are formed and the shadow-mask developed outline 54 having the outer periphery to form a skirt section by bending an ineffective area upward at the margin after press-molding are continuously formed on the low-carbon steel plate 1 and etched to form the slot 53 serving as an electron-beam passing hole.

After annealing, leveling, or surface treatment the shadow mask with the slots 53 is cut along the shadow-mask developed outline 54 to form a semi-finished shadow mask 5' and sent to the press molding process.

In the press molding process (D), the semifinished shadow mask 5' is press-molded by a mold having a domed external form of the shadow mask to obtain the shadow mask 5 shown in FIG. 4(D).

Etched slots formed in the shadow mask for passing the electron beam have their widths increasing or decreasing continuously as they are away from the center. The continuous increase or decrease of the slot width corresponds to the continuous expansion of the electron-beam cross section due to the increase of the deflection angle of an electron bean or the continuous change of the interval between a phosphor layer and a shadow mask tube.

When the shadow mask arranged as described above is press-molded, slots closer to the effective border have larger increase rate of the width or length than those in the central portion of the shadow mask.

That is, because the deformation force applied to a slot formed at the effective border when it is press-molded is larger than that at the central portion, slots located at the effective border, particularly at the corner section have larger increase rates of the width or length than those at the central portion due to the deformation force.

A color cathode ray tube having a shadow mask structure as described has a problem of the so-called decrease of landing tolerance in which the diameter of an electron beam is increased particularly at a corner section and thereby an electron beam is deviated from a predetermined phosphor constituting phosphor mosaic to excite even an adjacent phosphor.

As a result, the color purity is deteriorated and therefore a reproduced image with a high image quality cannot be obtained.

The official gazette of Japanese Patent Laid-Open No. 62436/1991 discloses a prior art relating to the slot width of a shadow mask.

SUMMARY OF THE INVENTION

The present invention is made to solve the problems of the prior art and its object is to provide a shadow mask that prevents the abnormal increase in width or length of slots at corners in an effective area. It is another object of the present invention to provide a shadow-mask cathode ray tube that produce a high quality image.

To achieve the above objects, the present invention applies the following constitution to a shadow mask.

That is, the present invention achieves the above objects by giving a proper relation to the slot shape at the outermost line and slot shapes at lines inside of the outermost line along the horizontal scanning direction among the slots formed in an effective area.

Specifically, the above objects are achieved by the following constitutions.

1. The slot width at the outermost line and slot widths at lines inside of the outermost line are set to a proper relation particularly at a corner section.

2. The slot height at the outermost line and slot heights at lines inside of the outermost line are set to a proper relation particularly at a corner section.

3. The width of the so-called bridge for connecting the slot at the outermost line and slots at lines inside of the outermost line in the vertical scanning direction is set to a proper relation particularly at a corner section.

By using at least one of the above constitutions or a combination of them, it is possible to prevent the width and length of slots of a shadow mask particularly at its corner section from being extremely increased due to the deformation force under press-molding and to keep the size of the slot at the corner section after being press-molded at a proper value.

Therefore, it is possible to adequately secure the landing tolerance of an electron beam and provide a reproduced image with a high quality.

DESCRIPTION OF THE PREFERRED EMBODIMENTS

Embodiments of the present invention are described below by referring to the accompanying drawings.

Figure 1:
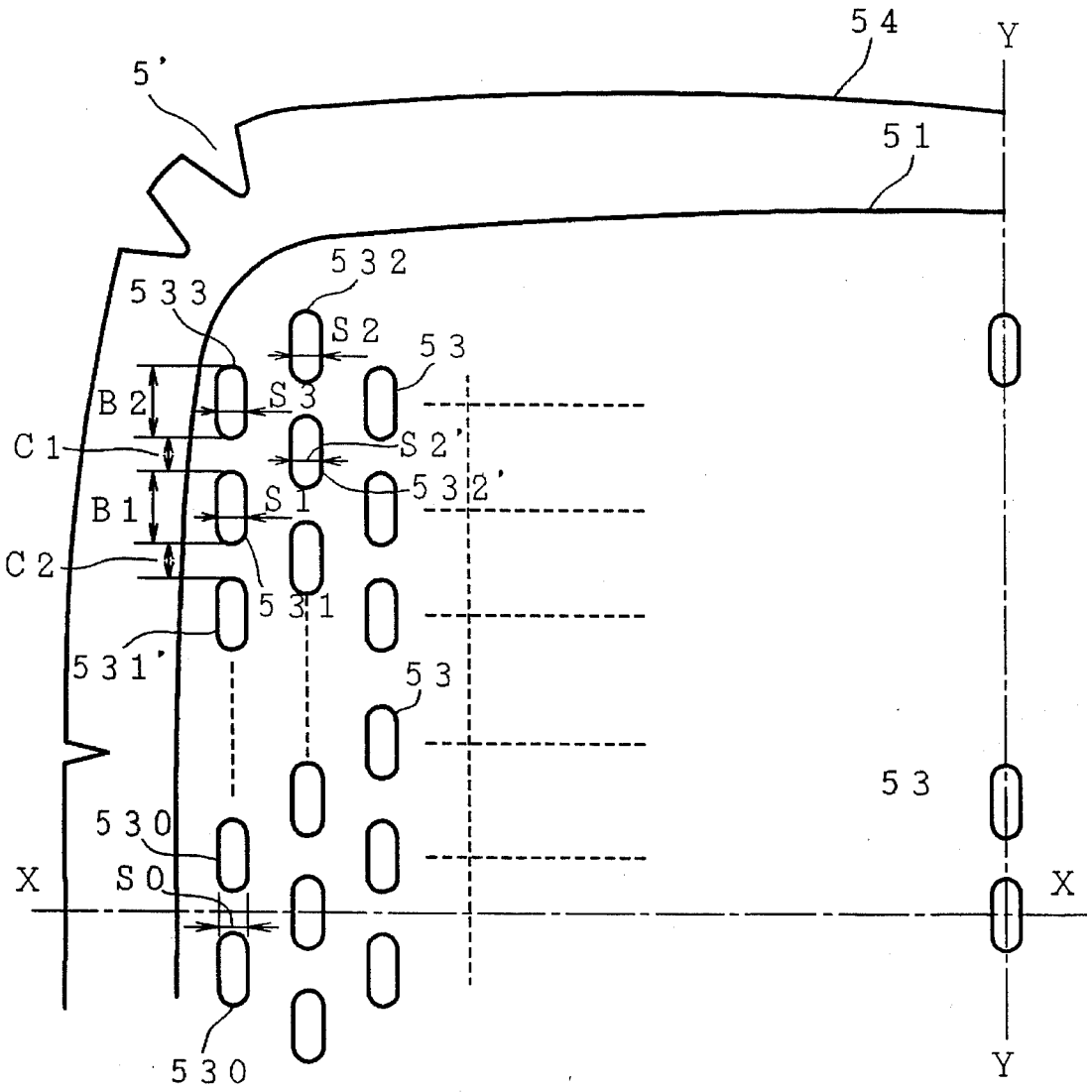
FIG. 1 is a schematic view of the main portion of a semi-finished shadow mask before being press-molded for explaining an embodiment of the shadow mask of the present invention.
Figure 2:
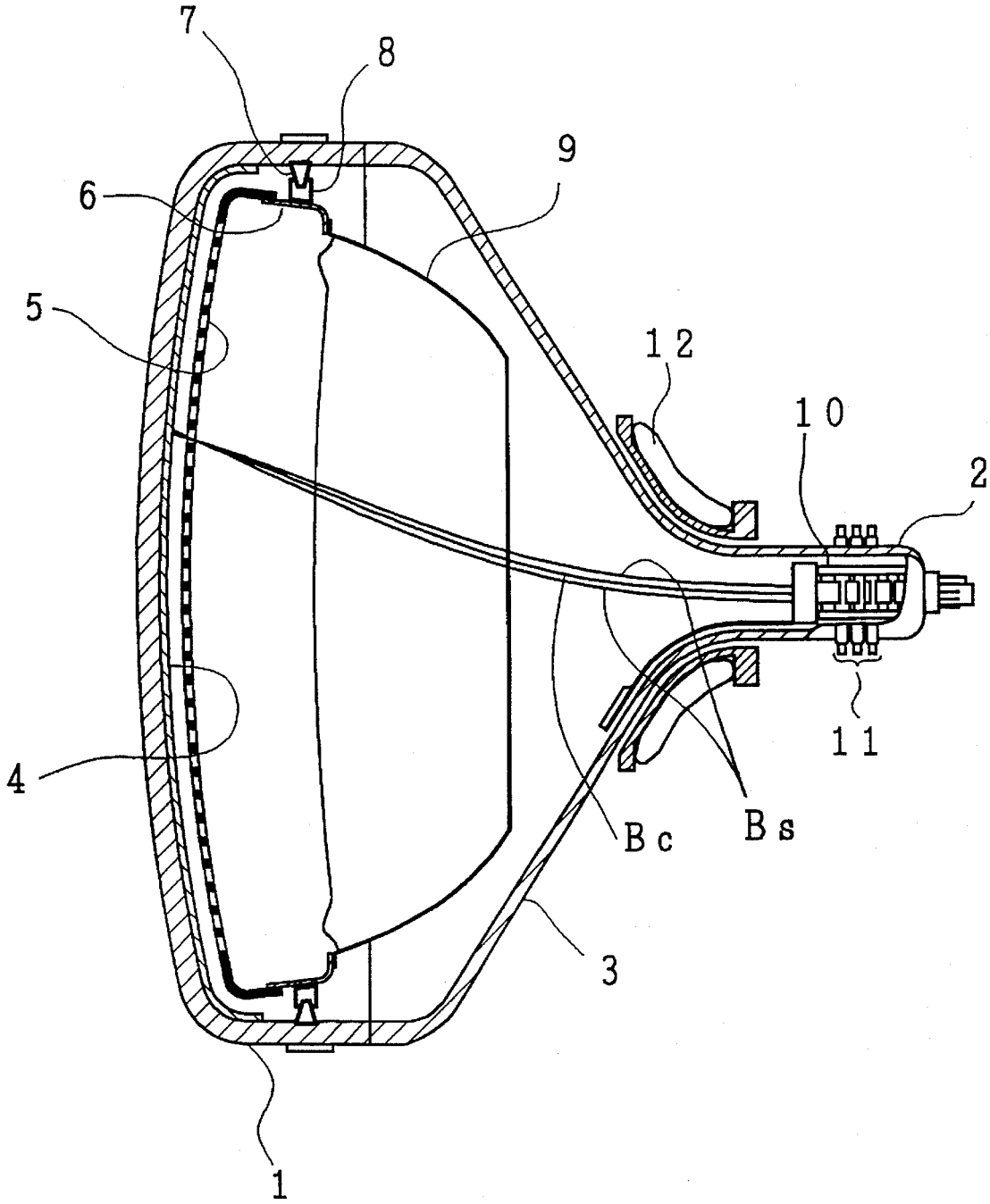
FIG. 2 is a sectional view of a shadow-mask color cathode ray tube for explanation.

FIG. 1 is a schematic view of the main portion of a semi-finished shadow mask before press-molded for explaining an embodiment of the shadow mask of the present invention, in which symbol 5' represents a semi-finished shadow mask, 51 represents an effective border, 53 represents a slot, and 54 represents a shadow-mask developed outline.

Figure 3A:
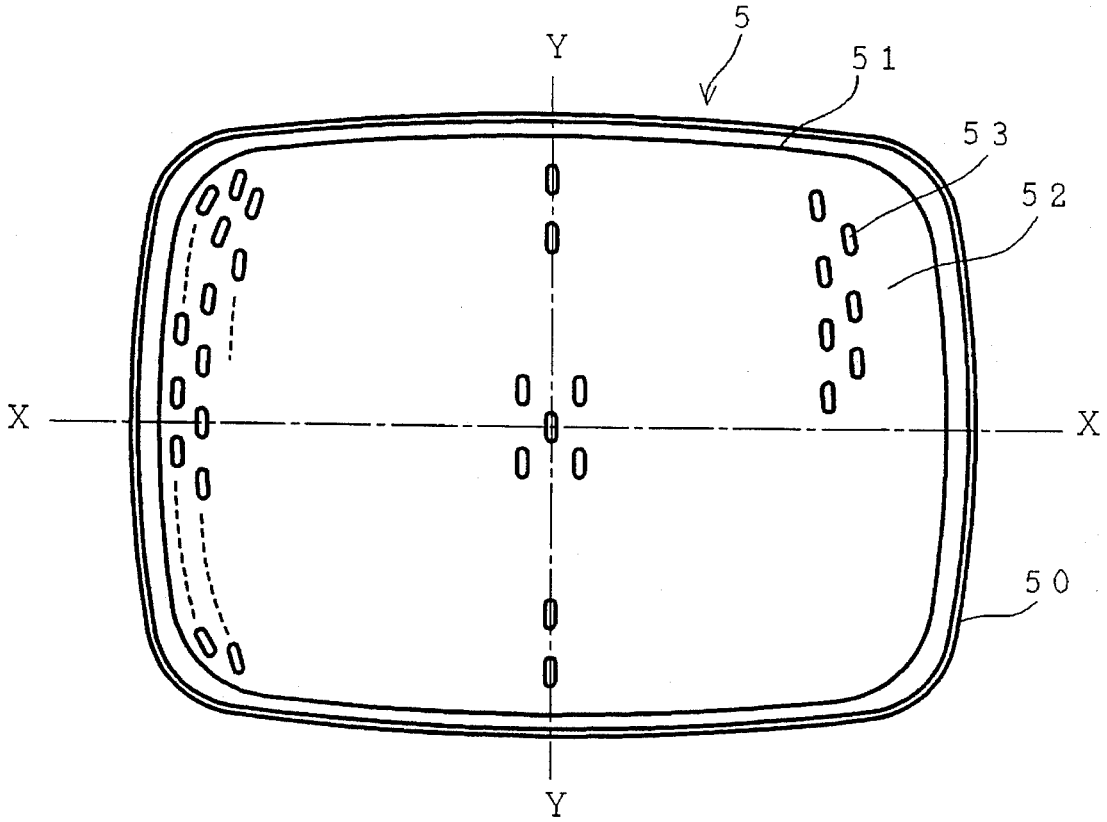
FIG. 3*a* is an illustration of a shadow mask viewed from the electron gun side.
Figure 3B:
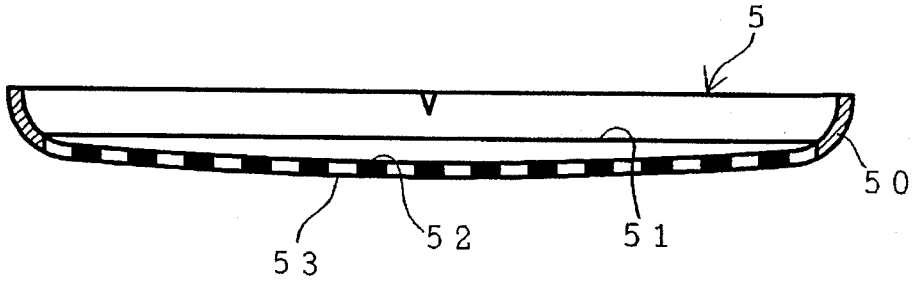
FIG. 3*b* is a cross sectional view of the shadow mask in FIG. 3*a*, taken along the line X—X of FIG. 3*a*.
Figure 4A:
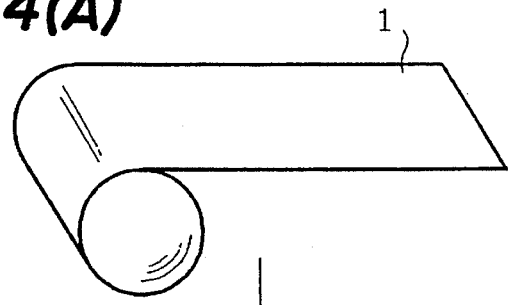
FIGS. 4(A) to 4(D) are schematic process diagrams for roughly explaining a shadow mask manufacturing method.
Figure 4B:
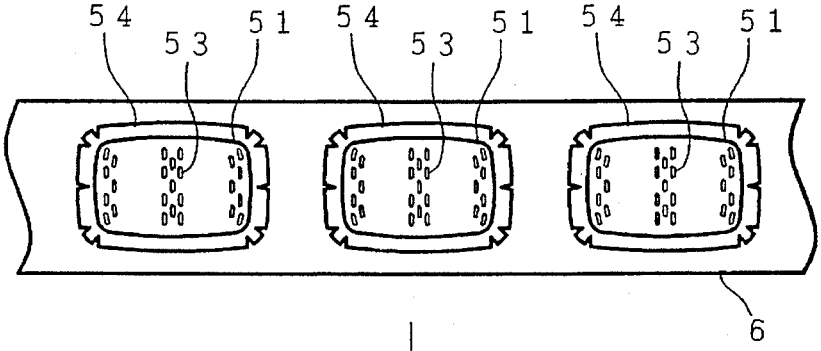
Figure 4C:
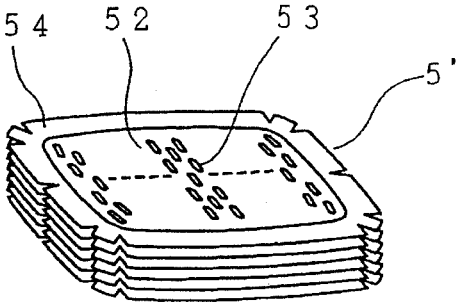
Figure 4D:
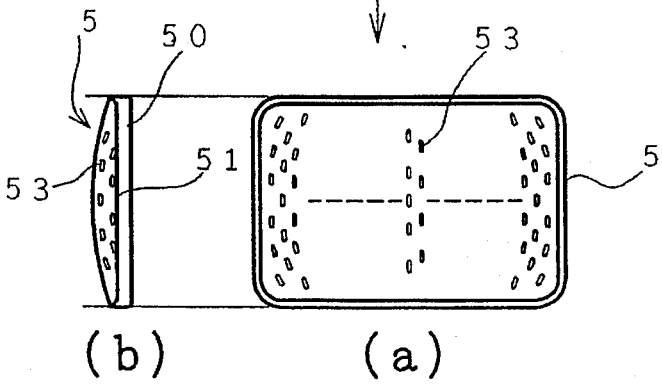

In FIG. 1, the semi-finished shadow mask 5' is already etched as described above in FIG. 4. A plurality of slots 53 are formed in the internal area surrounded by the effective border 51 and the area present between the effective border 51 and the shadow-mask developed outline 54 is a portion serving as the skirt section 50 (FIG. 3) for press-molding.

First Embodiment

In FIG. 1, slots 53 are formed so that S3<S2, S3<S2' and S3<S1 may be satisfied, where S3 is the slot width of a first-end electron-beam passing hole 533 located at the end of the vertical-scanning-directional outermost line at the corner section in the horizontal scanning direction X—X in the effective area, S2 is the slot width of a second-end electron-beam passing hole 532 located at the end of the line in the vertical scanning direction Y—Y adjacent to the first-end electron-beam passing hole 533 in the horizontal scanning direction, S2' is the slot width of a third-end electron-beam passing hole 532' adjacent to the second-end electron-beam passing hole 532 in the vertical scanning direction, S1 is the slot width of a fourth-end electron-beam passing hole 531 adjacent to the first-end electron-beam passing hole 533 in the vertical scanning direction, B2 is the slot height of the first-end electron-beam passing hole 533, and B1 is the slot height of the fourth-end electron-beam passing hole 531 adjacent to the first-end electron-beam passing hole in the vertical scanning direction.

By press-molding the semi-finished shadow mask 5' on which slots are formed, it is possible to obtain an approximately rectangular domed shadow mask in which the slot width at the corner section is set to a proper value.

As the result of examining the slot width and slot height of a press-molded shadow mask, it is found that the relation between slot width and slot height which is the same as the case of the semi-finished shadow mask 5' still frequently appears though the slot width and slot height are more uniformed than the case of the semi-finished shadow mask 5'.

Thereby the landing tolerance of an electron beam is adequately secured, and it is possible to provide a reproduced image with a high quality.

Second Embodiment

In FIG. 1, the slot 53 is formed so that the opening shape of an electron beam formed in the effective area is the slot type having a major axis in the vertical scanning direction and the inequality S1<S0 is satisfied, where S3 is the slot width of the first-end electron-beam passing hole 533 located at the end of the vertical-scanning-directional outermost line at the horizontal-scanning-directional corner section in the effective area, S2 is the slot width of the second-end electron-beam passing hole 532 located at the end of a vertical-scanning-directional line adjacent to the first-end electron-beam passing hole 533 in the horizontal scanning direction, S2' is the slot width of the third-end electron-beam passing hole 532' adjacent to the second-end electron-beam passing hole 532 in the vertical scanning direction, S1 is the slot width of the fourth-end electron-beam passing hole 531 adjacent to the first-end electron-beam passing hole 533 in the vertical scanning direction, S0 is the slot width of a fifth-end electron-beam passing hole 530 located at the central portion of the vertical-scanning-directional outermost line at the center of the effective face area in the horizontal scanning direction, B2 is the slot height of the first-end electron-beam passing hole 533, and B1 is the slot height of the fourth-end electron-beam passing hole 531 adjacent to the first-end electron-beam passing hole 533 in the vertical scanning direction.

Thus, by press-molding the semi-finished shadow mask 5' on which slots are formed, an approximately rectangular domed shadow mask in which the slot width at the corner section is set to a proper value is obtained. A preferable result is obtained by adding the constitution of the first embodiment to the above constitution.

As the result of examining the slot width and slot height of a press-molded shadow mask, it is found that the relation between slot width and slot height which is the same as the case of the semi-finished shadow mask 5' still frequently appears though the slot width and slot height are more uniformed than the case of the semi-finished shadow mask 5'.

Thereby the landing tolerance of an electron beam is adequately secured, and it is possible to provide a reproduced image with a high quality.

Third Embodiment

The slots 53 are formed so that the inequality B2<B1 may be satisfied, where S3 is the slot width of the first-end electron-beam passing hole 533 located at the end of the vertical-scanning-directional outermost line at the horizontal-scanning-directional corner section in the effective area, S2 is the slot width of the second-end electron-beam passing hole 532 located at the end of a vertical-scanning-directional line adjacent to the first-end electron-beam passing hole 533 in the horizontal scanning direction, S2' is the slot width of the third-end electron-beam passing hole 532' adjacent to the second-end electron-beam passing hole 532 in the vertical scanning direction, S1 is the slot width of the fourth-end electron-beam passing hole 531 adjacent to the first-end electron-beam passing hole 533 in the vertical scanning direction, B2 is the slot height of the first-end electron-beam passing hole 533, and B1 is the slot height of the fourth-end electron-beam passing hole 531 adjacent to the first-end electron-beam passing hole 533 in the vertical scanning direction.

Thus, by press-molding the semi-finished shadow mask 5' on which slots are formed, it is possible to obtain an approximately rectangular domed shadow mask in which the slot width at the corner section is set to a proper value. A preferable result is obtained by adding the constitution of the first embodiment to the above constitution.

As the result of examining the slot width and slot height of a press-molded shadow mask, it is found that the relation between slot width and slot height which is the same as the case of the semi-finished shadow mask 5' still frequently appears though the slot width and slot height are more uniformed than the case of the semi-finished shadow mask 5'.

Thereby the landing tolerance of an electron beam is adequately secured, and it is possible to provide a reproduced image with a high quality.

Fourth Embodiment

The slots 53 are formed so that the inequalities S3<S2, S3<S2', S3<S1, Sl<S0, and B2<B1 may be satisfied, where S3 is the slot width of the first-end electron-beam passing hole 533 located at the end of the vertical-scanning-directional outermost line at the horizontal-scanning-directional corner section in the effective area, S2 is the slot width of the second-end electron-beam passing hole 532 located at the end of a vertical-scanning-directional line adjacent to the first-end electron-beam passing hole 533 in the horizontal scanning direction, S2' is the slot width of the third-end electron-beam passing hole 532' adjacent to the second-end electron-beam passing hole 532 in the vertical scanning direction, S1 is the slot width of the fourth-end electron-beam passing hole 531 adjacent to the first-end electron-beam passing hole 533 in the vertical scanning direction, S0 is the slot width of the fifth-end electron-beam passing hole 530 located at the central portion of the vertical-scanning-directional outermost line at the center of the effective area in the vertical scanning direction, B2 is the slot height of the first-end electron-beam passing hole 533, and B1 is the slot height of the fourth-end electron-beam passing hole 531 adjacent to the first-end electron-beam passing hole 533 in the vertical scanning direction.

Thus, by press-molding the semi-finished shadow mask 5' on which slots are formed, it is possible to obtain an approximately rectangular domed shadow mask in which the slot width at the corner section is set to a proper value.

As the result of examining the slot width and slot height of a press-molded shadow mask, it is found that the relation between slot width and slot height which is the same as the case of the semi-finished shadow mask 5' still frequently appears though the slot width and slot height are more uniformed than the case of the semi-finished shadow mask 5'.

Thereby the landing tolerance of an electron beam is adequately secured, and it is possible to provide a reproduced image with a high quality.

A slot whose width and height are set is not necessarily restricted to the above first- to fifth-end electron-beam passing holes but it can be applied to each of the above electron-beam passing holes and a slot adjacent to each of them.

Fifth Embodiment

A portion for connecting slots of each line in the vertical scanning direction is defined as a bridge.

The slot 53 is formed so that the opening shape of an electron-beam passing hole formed by having a bridge in the effective area is the slot type having a major axis in the vertical scanning direction and the inequality C2<C1 may be satisfied, where S3 is the slot width of the first-end electron-beam passing hole 533 located at the end of the vertical-scanning-directional outermost line at the horizontal-scanning-directional corner section in the effective area, S2 is the slot width of the second-end electron-beam passing hole 532 located at the end of a vertical-scanning-directional line adjacent to the first-end electron-beam passing hole 533 in the horizontal scanning direction, S2' is the sloth width of the third-end electron-beam passing hole 532' adjacent to the second-end electron-beam passing hole 532 in the vertical scanning direction, S1 is the slot width of the fourth-end electron-beam passing hole 531 adjacent to the first-end electron-beam passing hole 533 in the vertical scanning direction, B2 is the slot height of the first-end electron-beam passing hole 533, B1 is the slot height of the fourth-end electron-beam passing hole 531 adjacent to the first-end electron beam passing hole 533 in the vertical scanning direction, C1 is the bridge extent between the first-end electron-beam passing hole 533 and the fourth-end electron-beam passing hole 531 by having a sixth electron-beam passing hole 531' adjacent to the fourth-end electron-beam passing hole 531 in the vertical scanning directional outermost line, and C2 is the bridge extent between the fourth-end electron-beam passing hole 531 and the sixth-end electron-beam passing hole 531'.

Moreover, a preferable result is obtained by adding the relation between slot width and slot height shown in the embodiments 1, 2, 3, and 4 to the relation of the above bridge extent.

Thus, by press-molding the semi-finished shadow mask 5' on which slots are formed, it is possible to obtain an approximately rectangular domed shadow mask in which the slot width at the corner section is set to a proper value.

As the result of examining the slot width and slot height of a press-molded shadow mask, it is found that the relation between slot width and slot height which is the same as the case of the semi-finished shadow mask 5' still frequently appears though the slot width and slot height are more uniformed than the case of the semi-finished shadow mask 5'.

Thereby the landing tolerance of an electron beam is adequately secured, and it is possible to provide a reproduced image with a high quality.

As described above, the present invention makes it possible to provide a shadow-mask color cathode ray tube for producing a preferable quality image free from color mixture by preventing the width or length of a slot from extremely increasing when a shadow mask is press-molded and thereby controlling the landing diameter of an electron beam to a proper value.

What is claimed is:

1. A shadow-mask color cathode ray tube having a shadow mask for selectively passing a plurality of electron beams coming from an electron gun to land them on their corresponding phosphors of different colors constituting a screen;

wherein the shadow mask is constituted by forming a flat plate into an approximately rectangular shape having an approximately rectangular effective area in which a plurality of slot-like electron-beam passing holes are formed in horizontal and vertical directions and an ineffective area surrounds the effective area, and thereafter, forming a skirt section by press-molding the approximately rectangular plate to bend the ineffective area upward at a margin of the approximately rectangular plate and forming the effective area into an approximately rectangular dome and welding the dome to a mask frame;

wherein an electron-beam passing hole which is located at an end of a vertical-directional outermost line at a horizontal-directional section in the effective area is defined as a first-end electron-beam passing hole, an electron-beam passing hole which is located adjacent to the first-end electron-beam passing hole in the horizontal direction and at an end of a vertical-directional line adjacent to the vertical-directional outermost line is defined as a second-end electron-beam passing hole, an electron-beam passing hole which is located adjacent to the second-end electron-beam passing hole in the vertical directional line is defined as a third-end electron-beam passing hole, an electron-beam passing hole which is located adjacent to the first-end electron-beam passing hole in the vertical-directional outermost line is defined as a fourth-end electron-beam passing hole, and an electron-beam passing hole which is located at a central portion of the vertical-directional outermost line is defined as a fifth-end electron-beam passing hole; and wherein an opening shape of a slot type electron-beam passing hole formed in the effective area has a major axis in the vertical-direction, and inequalities S3<S2, S3<S2', and S3<S1 are satisfied, where S3 is a slot width of the first-end electron-beam passing hole, S2 is a slot width of the second-end electron-beam passing hole, S2' is a slot width of the third-end electron-beam passing hole, and S1 is a slot width of the fourth-end electron-beam passing hole.

2. The shadow-mask color cathode ray tube according to claim 1, wherein an inequality S1<S0 is satisfied, where S0 is a slot width of the fifth-end electron-beam passing hole.

3. The shadow-mask color cathode ray tube according to claim 1, wherein an inequality B2<B1 is satisfied, where B2 is a slot height of the first-end electron-beam passing hole and B1 is a slot height of the fourth-end electron-beam passing hole.

4. The shadow-mask color cathode ray tube according to claim 3, wherein an inequality S1<S0 is satisfied, where S0 is a slot width of the fifth-end electron-beam passing hole.

5. A shadow-mask color cathode ray tube having a shadow mask for selectively passing a plurality of electron beams coming from an electron gun to land them on their corresponding phosphors of different colors constituting a screen;

wherein the shadow mask is constituted by forming a flat plate into an approximately rectangular shape having an approximately rectangular effective area in which a plurality of slot-like electron-beam passing holes are formed in horizontal and vertical directions and an ineffective area surrounds the effective area, and thereafter, forming a skirt section by press-molding the approximately rectangular plate to bend the ineffective area upward at a margin of the approximately rectangular plate and forming the effective area into an approximately rectangular dome and welding the dome to a mask frame;

wherein an electron-beam passing hole which is located at an end of a vertical-directional outermost line at a horizontal-directional section in the effective area is defined as a first-end electron-beam passing hole, an electron-beam passing hole which is located adjacent to the first-end electron-beam passing hole in the horizontal direction and at an end of a vertical-directional line adjacent the vertical-directional outermost line is defined as a second-end electron-beam passing hole, an electron-beam passing hole which is located adjacent to the second-end electron-beam passing hole in the vertical-directional line is defined as a third-end electron-beam passing hole, an electron-beam passing hole which is located adjacent to the first-end electron-beam passing hole in the vertical-directional outermost line is defined as a fourth-end electron-beam passing hole, an electron-beam passing hole which is located at a central portion of the vertical-directional outermost line is defined as a fifth-end electron-beam passing hole, and an electron-beam passing hole which is located adjacent to the fourth-end electron beam passing hole in the vertical-directional outermost line is defined as a sixth-end electron-beam passing hole; and wherein an opening shape of a slot type electron-beam passing hole formed by having a bridge section in the effective area has a major axis in the vertical direction and an inequality C2<C1 is satisfied, where C1 is a bridge extent of the bridge section in the vertical direction between the first-end electron-beam passing hole and the fourth-end electron beam passing hole, and C2 is a bridge extent of the bridge section in the vertical direction between the fourth-end electron-beam passing hole and the sixth-end electron beam passing hole.

6. The shadow-mask color cathode ray tube according to claim 5, wherein inequalities S3<S2, S3<S2', and S3<S1 are satisfied, where S3 is a slot width of the first-end electron-beam passing hole, S2 is a slot width of the second-end electron-beam passing hole, S2' is a slot width of the third-end electron-beam passing hole, and S1 is a slot width of the fourth-end electron-beam passing hole.

7. The shadow-mask color cathode ray tube according to claim 6, wherein an inequality S1<S0 is satisfied, where S0 is a slot width of the fifth-end electron-beam passing hole.

8. The shadow-mask color cathode ray tube according to claim 7, wherein an inequality B2<B1 is satisfied, where B2 is a slot height of the first-end electron-beam passing hole and B1 is a slot height of the fourth-end electron-beam passing hole.

9. A shadow-mask color cathode ray tube, constituted by forming a flat plate into an approximately rectangular shape having an approximately rectangular effective area in which a plurality of slot-like electron-beam passing holes are formed in horizontal and vertical directions of an electron beam, and an ineffective area surrounds the effective area;

wherein an electron-beam passing hole which is located at an end of a vertical-directional outermost line at a horizontal-directional section in the effective area is defined as a first-end electron-beam passing hole, an electron-beam passing hole which is located adjacent to the first-end electron-beam passing hole in the horizontal direction and at an end of a vertical-directional line adjacent to the vertical-directional outermost line is defined as a second-end electron-beam passing hole, an electron-beam passing hole which is located adjacent to the second-end electron-beam passing hole in the vertical directional line is defined as a third-end electron-beam passing hole, an electron-beam passing hole which is located adjacent to the first-end electron-beam passing hole in the vertical-directional outermost line is defined as a fourth-end electron-beam passing hole, and an electron-beam passing hole which is located at a central portion of the vertical-directional outermost line is defined as a fifth-end electron-beam passing hole; and wherein an opening shape of a slot type electron-beam passing hole formed in the effective area has a major axis in the vertical-direction, and inequalities S3<S2, S3'<S2', and S3<S1 are satisfied, where S3 is a slot width of the first-end electron-beam passing hole, S2 is a slot width of the second-end electron-beam passing hole, S2' is a slot width of the third-end electron-beam passing hole, and S1 is a slot width of a fourth-end electron-beam passing hole.

10. The shadow-mask color cathode ray tube according to claim 9, wherein an inequality S1<S0 is satisfied, where S0 is a slot width of the fifth-end electron-beam passing hole.

11. The shadow-mask color cathode ray tube according to claim 9, wherein an inequality B2<B1 is satisfied, where B2 is a slot height of the first-end electron-beam passing hole and B1 is a slot height of the fourth-end electron-beam passing hole.

12. The shadow-mask color cathode ray tube according to claim 11, wherein an inequality S1<S0 is satisfied, where S0 is a slot width of the fifth-end electron-beam passing hole.

13. A shadow-mask color cathode ray tube, constituted by forming a flat plate into an approximately rectangular shape having an approximately rectangular effective area in which a plurality of slot-like electron-beam passing holes are formed in horizontal and vertical directions of an electron beam, and an ineffective area surrounds the effective area;

wherein an electron-beam passing hole which is located at an end of a vertical-directional outermost line at a horizontal-directional section in the effective area is defined as a first-end electron-beam passing hole, an electron-beam passing hole which is located adjacent to the first-end electron-beam passing hole in the horizontal direction and at an end of a vertical-directional line adjacent the vertical-directional outermost line is defined as a second-end electron-beam passing hole, an electron-beam passing hole which is located adjacent to the second-end electron-beam passing hole in the vertical-directional line is defined as a third-end electron-beam passing hole, an electron-beam passing hole which is located adjacent to the first-end electron-beam passing hole in the vertical-directional outermost line is defined as a fourth-end electron-beam passing hole, an electron-beam passing hole which is located at a central portion of the vertical-directional outermost line is defined as a fifth-end electron-beam passing hole, and an electron-beam passing hole which is located adjacent to the fourth-end electron beam passing hole in the vertical-directional outermost line is defined as a sixth-end electron-beam passing hole; and wherein an opening shape of a slot type electron-beam passing hole formed by having a bridge section in the effective area has a major axis in the vertical direction and an inequality C2<C1 is satisfied, where C1 is a bridge extent of the bridge section in the vertical direction between the first-end electron-beam passing hole and the fourth-end electron beam passing hole, and C2 is a bridge extent of the bridge section in the vertical direction between the fourth-end electron-beam passing hole and the sixth-end electron-beam passing hole.

14. The shadow mask according to claim 13, wherein inequalities S3<S2, S3<S2', and S3<S1 are satisfied, where S3 is a slot width of the first-end electron-beam passing hole, S2 is a slot width of the second-end electron-beam passing hole, S2' is a slot width of the third-end electron-beam passing hole, and S1 is a slot width of the fourth-end electron-beam passing hole.

15. The shadow mask according to claim 14, wherein an inequality S1<S0 is satisfied, where S0 is a slot width of the fifth-end electron-beam passing hole.

16. The shadow mask according to claim 15, wherein an inequality B2<B1 is satisfied, where B2 is a slot height of the first-end electron-beam passing hole and B1 is a slot height of the fourth-end electron-beam passing hole.

* * * * *